United States Patent [19]

Williams

[11] Patent Number: 4,873,897

[45] Date of Patent: Oct. 17, 1989

[54] DEVICE FOR UNLOCKING CAR DOORS

[76] Inventor: Sam Williams, 1843 Winchester, Memphis, Tenn. 38116

[21] Appl. No.: 270,238

[22] Filed: Nov. 14, 1988

[51] Int. Cl.[4] ..... E05B 19/20

[52] U.S. Cl. ..... 81/15.9

[58] Field of Search ..... 81/488, 15.9; 70/465, 70/395; 294/19.1

[56] References Cited

U.S. PATENT DOCUMENTS

| | | | |
|---|---|---|---|
| 2,027,009 | 1/1936 | Wyscaver | 81/15.9 |
| 4,144,778 | 3/1979 | Waring | 81/15.9 |
| 4,608,886 | 9/1986 | Bolton | 81/15.9 |
| 4,655,102 | 4/1987 | Parkins | 81/15.9 |
| 4,683,783 | 8/1987 | Fanberg | 81/15.9 |

*Primary Examiner*—Roscoe V. Parker

*Attorney, Agent, or Firm*—Mark J. Patterson

[57] ABSTRACT

A device is provided for the unlocking of car doors despite the existence of anti-theft devices such as an inner shell. The device is bent in such a way so as to circumvent the inner shell placed in car doors by manufacturers which prevent the use of other door unlocking devices. The device also is bent in such a way so as to unlock a car door despite the existence of anti-theft devices such as plastic coating on the locking bar that prevents other earlier devices from being used. The device is a continuous metallic rod bent at precise angles and at precise lengths so as to take advantage of the spaces in between the window and the outer shell, the hole within the inner shell, and the distance between the hole and the inner shell and the locking device. The device is constructed very efficiently and cheaply.

1 Claim, 3 Drawing Sheets

DEVICE FOR UNLOCKING CAR DOORS

BACKGROUND OF THE INVENTION

This invention relates generally to car door opening tools, and more particularly to a device which can unlock a car door from the outside despite the fact that the locking bar located within the door has been covered with a protective inner shell as an anti-theft device.

It will be appreciated by those skilled in the art that it is often necessary for car doors to be unlocked without a set of keys. Not only is this ability necessary for persons who have locked their keys within their car, it is also necessary for tow truck operators and police in order to enter a locked car for the purpose of moving it. Often, a person is left with the sole option of breaking one of the car windows to gain access.

The initial attempts at opening car doors from the outside began with a coat hanger-type device. This coat hanger device would be inserted in between the window frame and the window and would be guided back to the door lock. The hanger type device then would grasp the door lock and pull it up. Auto makers circumvented this method by inserting either child proof locks or locks without any means to be grasped with a coat hanger type device.

The next development was the use of the slim jim. The slim jim is merely a strip of metal with notches placed in it. This strip is placed in between the window and the door frame from the outside and slid in until it hooks the locking mechanism. The slim jim would then be pulled up and the door would be unlocked. Auto makers circumvented this method by replacing old pivotal-type locking systems with new horizontal locking bar systems.

The next attempt was made using a wire-type device that would fit in between the window and the outer door shell. These devices have hooks at the end whereby the wire would be inserted in between the window and the outer door shell and twisted in a manner so that the hook would grasp onto the locking bar. After the lock bar was grasped by the hook, the device would be twisted to provide friction in-between the hook and the locking bar. The device would then be moved laterally by pulling on string attached to the hook to unlock the door. Auto makers circumvented this method by replacing the horizontal bar system with a vertical locking system and placing a protective inner shell in between the outer shell and the lock mechanism. Even if the device was placed in between the window and the outer shell, the inner shell prevented the device from coming into contact with the locking mechanism.

U.S. Pat. No. 4,144,778 issued to B. Waring on Mar. 20, 1979, discloses a device whereby a strip of metal is bent back against itself to form an acute angle between the long member and the shorter member. A wire is threaded through the long member and attaches to the end of the short member. At the end of the short member a notch is made. This device is inserted into the car door in between the window and the door shell. The short member is allowed to extend away from the long member by allowing slack on the wire. The notch at the end grasps the door lock and the device is pulled up and the door is unlocked. Recently, manufacturers of certain cars, particularly General Motors cars, have inserted the inner shell in between the outer shell and the door lock mechanism. The Waring device would not work because it would never be able to reach the lock mechanism.

U.S. Pat. No. 4,608,886 issed to R. Bolton on Sept. 2, 1986, discloses one of the previously mentioned hook type devices. The inner shell that car makers have placed into the car doors precludes this device this from working. Further, this device depends upon the hook being able to grasp the locking bar. The inner shell covers the locking bar and prevents the device from doing so.

U.S. Pat. No. 4,683,783 issued to V. Fanberg on Aug. 4, 1987, discloses a device very similar to the Bolton device. Therefore, it has the same flaw of not being able to penetrate the inner shell.

U.S. Pat. No. 4,655,102 issued to D. Parkins on Apr. 7, 1987, discloses a device that is basically a wire device with a saw-teeth member placed on its tip. This device is inserted in between the outer shell and into the car door interior and the saw-teeth member grasps the locking bar. This device will not work on the models that have the inner shell. The hole that is in the inner shell is far below the locking mechanism. Therefore, the Parkins device would never reach the locking mechanism because the device requires the hole to be in line with the locking mechanism.

Accordingly, it is an object of the present invention to provide a device to unlock car doors from the outside which can work in spite of the inner shell in between the outer shell and the lock mechanism.

It is a further object of this invention to provide a device that will unlock car doors quickly and efficiently.

SUMMARY OF THE INVENTION

Other objects and advantages will be obvious and will appear hereinafter, and will be accomplished by the present invention which provides a device for the unlocking of car doors despite the existence of an inner shell in the door. The device for unlocking car doors consists basically of a rod that is bent precisely to fit the contours of the inner workings of the car door. The device begins with a handle member which then becomes an elongated first section at a bend of an acute angle. The first section turns into the second section at an obtuse angle. The second section turns into the third section at a right angle. The third section turns into the fourth section at an obtuse angle. The fifth section arises out of the fourth section at an obtuse angle. The fifth section terminates at a tapered tip. The device is inserted into the car door in between the window and the door frame and through the weather stripping. The device is inserted down sufficiently so that the tip can pass through the hole that is placed by manufacturers into the inner shell. The device is then rotated so that the tip passes through the hole and the device is pulled up until the tip makes contact with the knob of the locking mechanism. Once this contact is made, the entire device is then pulled up once again and the door is unlocked. By pulling up on the knob of the locking mechanism, the locking bar is moved from a locked to an unlocked position.

The device is formed out of a bendable metallic rod of sufficient strength to withstand the force necessary to unlock the mechanism.

DESCRIPTION OF THE PREFERRED EMBODIMENT

Figure 1:
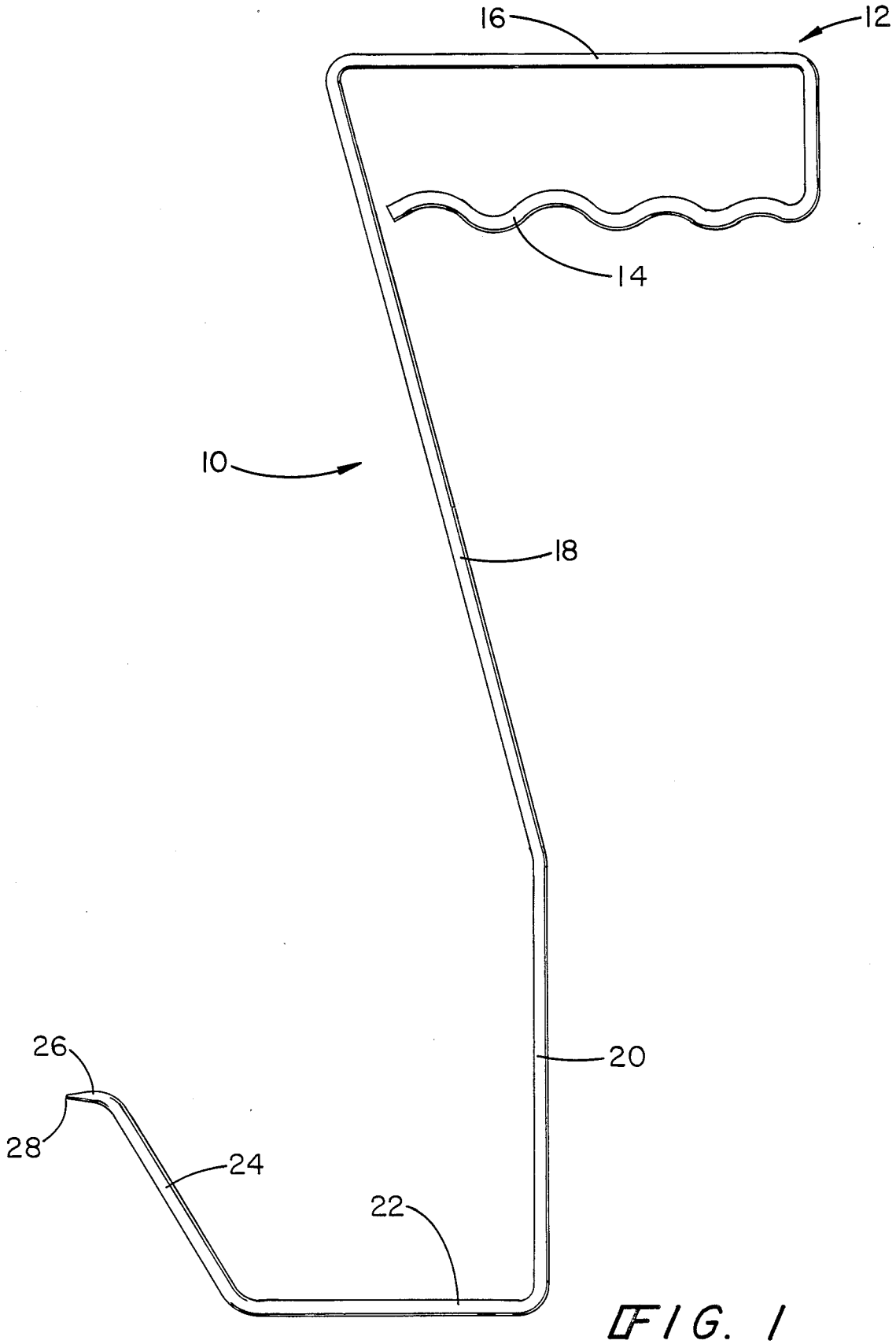
FIG. 1 is a side view of the device.

Referring now to FIG. 1, there is shown generally at 10 a device for unlocking car doors. As shown, device 10 is a continuous rod that is bent in a specific way. Preferably, the device is formed of ⅛" heat treated bar carbon steel. Device 10 begins with handle section 12 which has finger grip 14 and palm grip 16. Finger grip 14 is formed specifically with valleys and ridges so that user's fingers can be placed on it comfortably. Palm grip 16 is formed to fit comfortably within user's palm. Handle section 12 is given here for reference purposes only. It is not meant as a limitation of the entire invention. Device 10 is then bent at end of palm grip 16 to begin elongated first section 18. The angle between palm grip 16 and first section 18 is acute. Device 10 is then bent again at the end of first section 18 to begin second section 20. The angle between first section 18 and second section 20 is an obtuse angle. Third section 22 begins at end of second section 20 when device 10 is bent at a 90° angle. Device 10 is then bent again to form fourth section 24 which begins at end of third section 22. Angle between third section 22 and fourth section 24 is an obtuse angle. Device 10 is once again bent at an obtuse angle to form fifth section 26 at end of fourth section 24. End of fifth section 26 is tapered to form tip 28.

For reference only, the following dimensions and angles have been discovered to be operational through experimentation and development. Palm grip 16 is 4" long. The angle between palm grip 16 and first section 18 is 75° with the bend having a radius of ⅛". First section 18 is at least 6¼" long and second section 20 is 3¾". The angle between first section 18 and second section 20 is bent at 165 degrees with a radius of ¼". Ring 19 is placed or etched on first section 18 6¼" from angle between first section 18 and second section 20. The angle between second section 20 and third section 22 is 90° with a radius of ⅛". Third section 22 is 2⅝" long and the length of the fourth section 24 is 2⅛". The angle in between third section 22 and fourth section 24 is 125° with a radius of ¼". The angle in between fourth section 24 and fifth section 26 is 115° with a radius of ¼". The distance from the center point of the radial angle between fourth section 24 and fifth section 26 to the end of tip 28 is ⅜". The taper from fifth section 26 to tip 28 is 15°. The length of tip 28 is ⅛".

Figure 2:
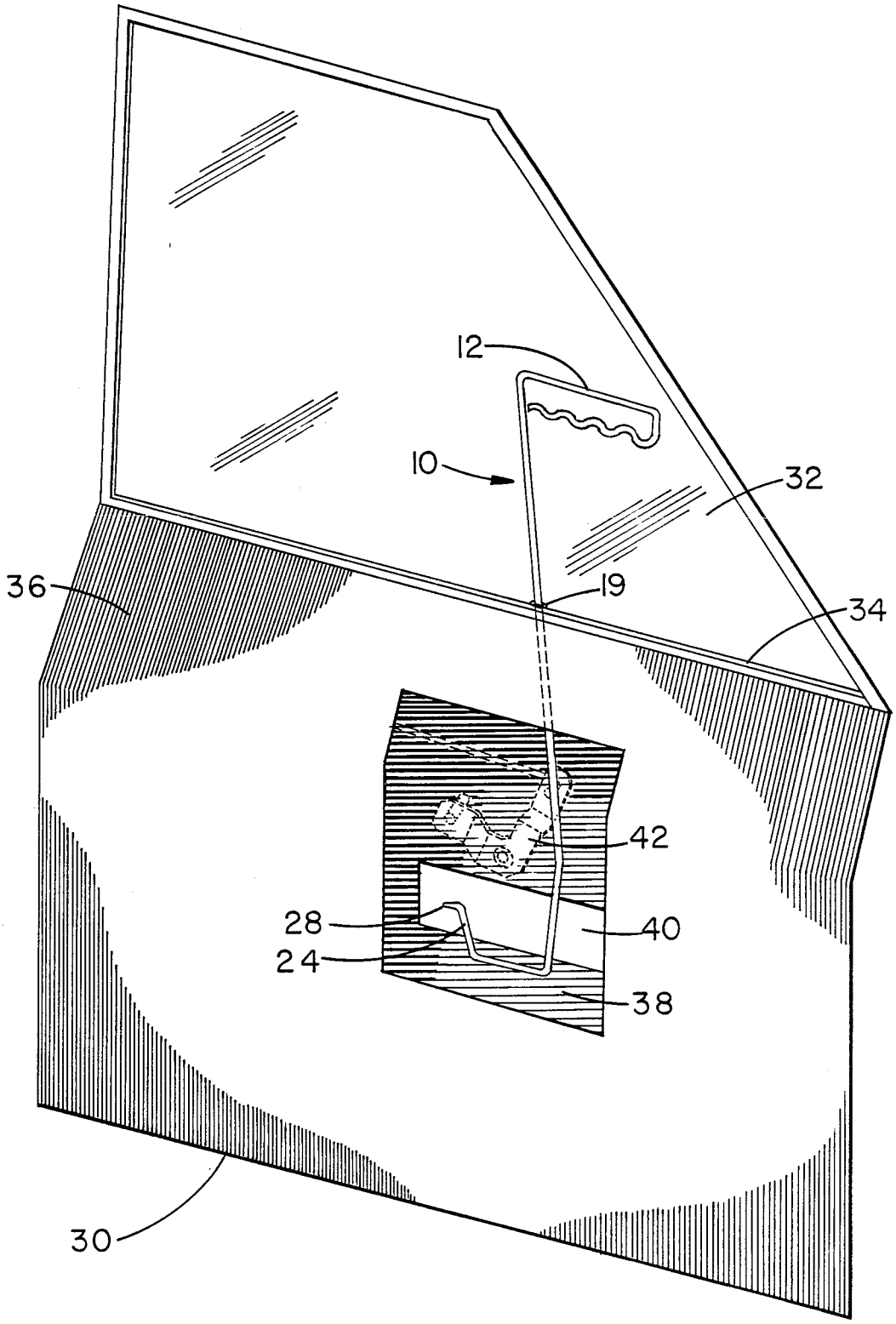
FIG. 2 is a side view of the passenger car door of a Buick Riviera with a cut out showing the inner shell and the locking mechanism.

Referring to FIG. 2, there is shown passenger door 30 of a Buick Riviera with outer shell 36 partially cut away to expose inner shell 38, hole 40, and, at an optically disposed vantage, locking mechanism 42. Device 10 is fed in between window 32 and outer shell 36. Device 10 is then fed through weather stripping 34 until at a sufficient distance into car door 30 such that tip 28 can pass through hole 40 using handle section 12 for leverage. Ring 19 is placed on device 10 to denote depth of penetration. When ring 19 becomes even with weather stripping 34, device 10 will pass through hole 40. Device 10 is twisted so that tip 28 passes through hole 40. Device 10 is then lifted up. Device 10 unlocks car door of 1987 and newer models of General Motors cars with vertical sliding locks such as the Buick Park Avenue, Cadillac El Dorado, Olds Toronado, and others.

Figure 3:
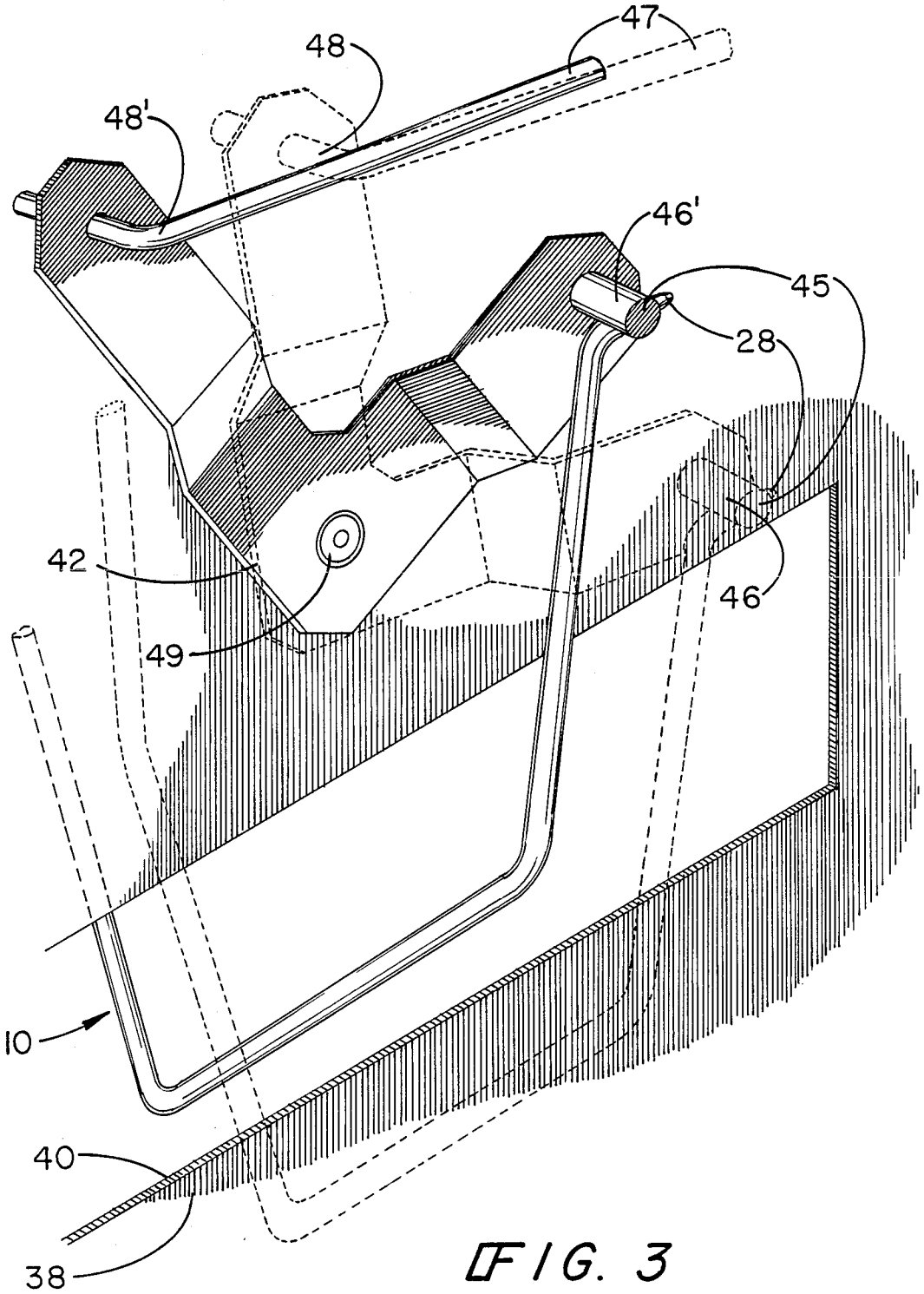
FIG. 3 is a side view of the locking mechanism showing the device as it fits through the hole in the inner shell and activates the locking mechanism.

Referring now to FIG. 3, there is shown lock mechanism 42 which rotates around pin 49. Here it is shown that device 10 is fed through hole 40 until tip 28 makes contact with knob 45 in locked position 46. Tip 28 may be flattened to achieve better contact with knob 45. Device 10 is then pulled up once again to move knob in locked position 46 to unlocked position 46'. Movement of knob 45 from locked position 46 to unlocked position 46' rotates lock mechanism 42 such that locking bar 47 in locked position 48 is moved to unlocked position 48'. Movement of lock mechanism 42 unlocks the door lock. Thus, although there has been described particular embodiments of the present invention of a device for unlocking car doors, it is not intended that such references be construed as limitations upon the scope of this invention except as set forth in the following claims.

What I claim is:

1. A convenient device for unlocking car doors having vertical sliding locks with certain anti-theft mechanisms comprising:

(a) an elongated first section following a handle section;

(b) a second section following said elongated first section forming an obtuse angle of substantially 165 degrees with a radius of approximately 0.250 inches, said second section defining a base axis;

(c) a third section following said second section forming approximately a 90 degree angle with a radius of substantially 0.125 inches;

(d) a fourth section following said third section forming substantially a 115 degree angle with a radius of approximately 0.250 inches away from said axis formed by said second section at substantially a 65 degree angle;

(e) a fifth section following said fourth section forming a 115 degree angle with a radius of approximately 0.250 inches, said fifth section being substantially perpendicularly in relation to said axis formed by said second section;

(f) a tip tapered at approximately 15 degree angle following said fifth section;

(g) a ring placed on said elongated first section 6.25 inches above beginning of said second section;

(h) said elongated first section is at least 6.25 inches long;

(i) said second section is substantially 3.750 inches long;

(j) said third section is approximately 2.625 inches long;

(k) said fourth section is substantially 2.125 inches long; and (l) said fifth section and said tip are approximately 0.375 inches long.

* * * * *